US007214141B2

(12) United States Patent
Hung

(10) Patent No.: US 7,214,141 B2
(45) Date of Patent: May 8, 2007

(54) AIR CUSHION TYPE SLEEVE OF A HANDLE OF A GOLF CLUB

(75) Inventor: Chi-Chih Hung, Feng-Shan (TW)

(73) Assignee: Eing Nan Rubber Co., Ltd., Kaohsiung Hsien (TW)

( * ) Notice: Subject to any disclaimer, the term of this patent is extended or adjusted under 35 U.S.C. 154(b) by 222 days.

(21) Appl. No.: 10/974,720

(22) Filed: Oct. 28, 2004

(65) Prior Publication Data

US 2006/0094525 A1 May 4, 2006

(51) Int. Cl.
*A63B 53/14* (2006.01)

(52) U.S. Cl. ..... 473/300; 473/568

(58) Field of Classification Search ..... 16/421, 16/431, 436, 443, DIG. 18; 15/143.1; 74/551.9, 74/543, 557; 81/489, 177.1, 177.3; 473/300–303, 473/531, 549, 550, 551, 568
See application file for complete search history.

(56) References Cited

U.S. PATENT DOCUMENTS 612,057 A * 10/1898 Richter ..... 74/551.9
5,171,011 A * 12/1992 Squadroni ..... 473/519
5,355,552 A * 10/1994 Huang ..... 16/421
5,575,473 A * 11/1996 Turner ..... 473/298
5,993,327 A * 11/1999 Terril ..... 473/297
6,367,125 B1 * 4/2002 Lin ..... 16/436
6,821,218 B2 * 11/2004 Byrne et al. ..... 473/568
6,832,413 B1 * 12/2004 Applewhite et al. ..... 16/430
6,968,599 B2 * 11/2005 Blauer et al. ..... 16/431

* cited by examiner

*Primary Examiner*—William M. Pierce
(74) *Attorney, Agent, or Firm*—Rosenberg, Klein & Lee

(57) ABSTRACT

A sleeve includes an inner sleeve part securely fitted on a handle end portion of a golf club, and two outer sleeve parts; the inner sleeve part has circular concavities spaced apart on an outer side thereof; the outer sleeve parts are positioned around the inner sleeve part, and each stuck to the inner sleeve part at two ends thereof in a sealing manner such that an air containing sealed room is formed between it and the inner sleeve part, making the sleeve capable of functioning like an air cushion with increased capability to absorb reaction force from hitting a golf ball.

5 Claims, 4 Drawing Sheets

AIR CUSHION TYPE SLEEVE OF A HANDLE OF A GOLF CLUB

BACKGROUND OF THE INVENTION

1. Field of the Invention

The present invention relates to a sleeve of a handle of a golf club, more particularly one, which is made in such a way as to function like an air cushion with softer touch and increased capability to absorb reaction force from hitting a golf ball.

2. Brief Description of the Prior Art

Referring to FIGS. 3 and 4, a conventional golf club 3 has a soft rubber sleeve 31 securely fitted around a handle portion thereof. The sleeve 31 has a fitting room 11, in which the handle portion is held, and a slip-prevention outer side 312. Because the sleeve 31 is made of soft rubber, it can reduce the reaction force against the user's hands when the golf club hits a ball. And, the slip-prevention outer side 312 of the sleeve 31 will prevent slip of the golf club while the club is being swung.

However, it is found that the sleeve has a limited shock absorbing capability, and the user's hands will hurt when the golf club hits a ball.

SUMMARY OF THE INVENTION

It is a main object of the invention to provide an improvement on a sleeve of a golf club handle to overcome the above disadvantage.

The sleeve of the present invention includes an inner sleeve part securely fitted on a handle end portion of a golf club, and two outer sleeve parts. The inner sleeve part has circular concavities spaced apart on an outer side thereof. The outer sleeve parts are positioned around the inner sleeve part, and each stuck to the inner sleeve part at two ends thereof in a sealing manner such that an air containing sealed room is formed between it and the inner sleeve part, making the sleeve capable of functioning like an air cushion with a softer touch and increased capability to absorb reaction force from hitting a golf ball.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
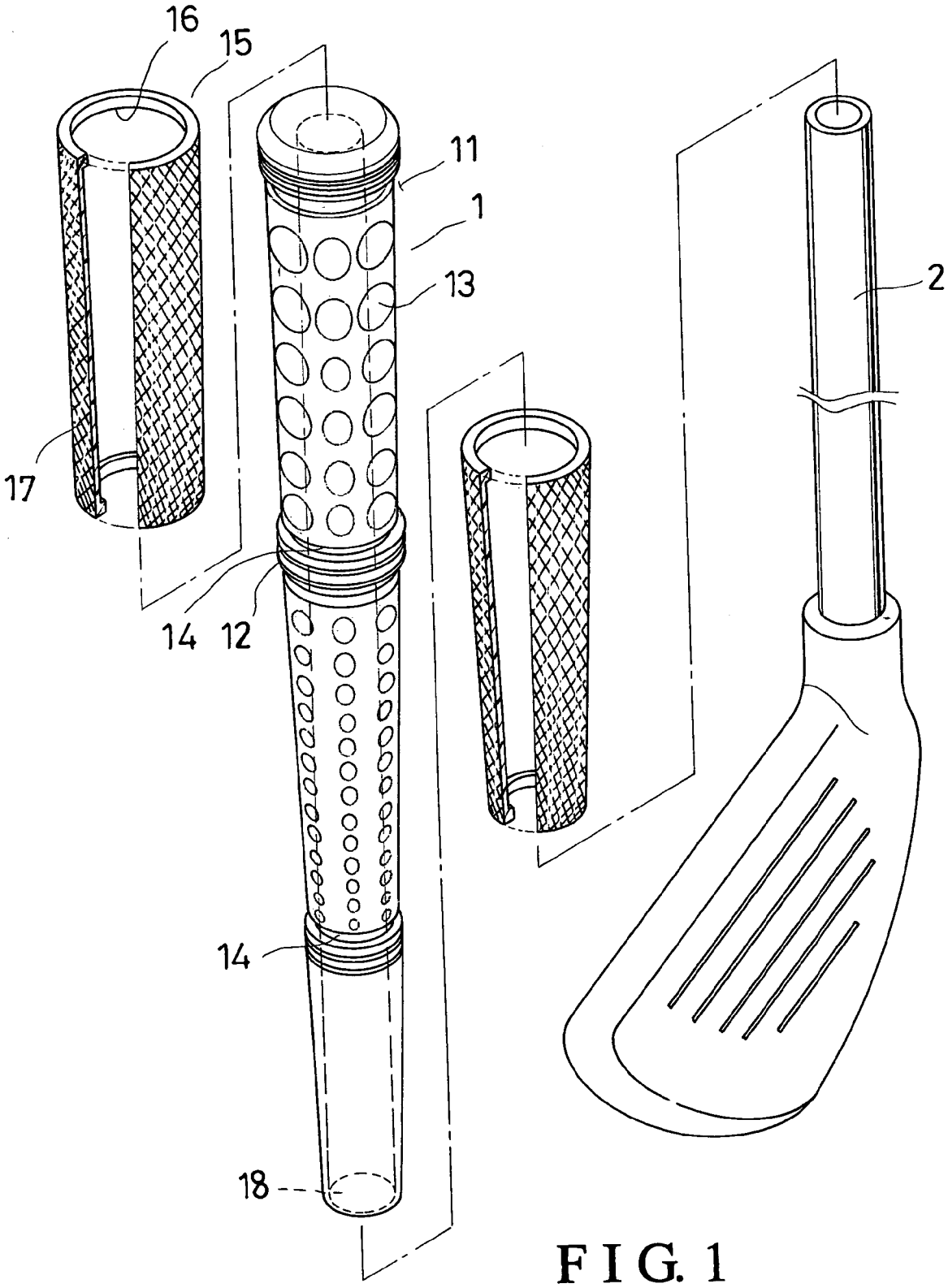
FIG. 1 is an exploded perspective view of the golf club according to the present invention.
Figure 2:
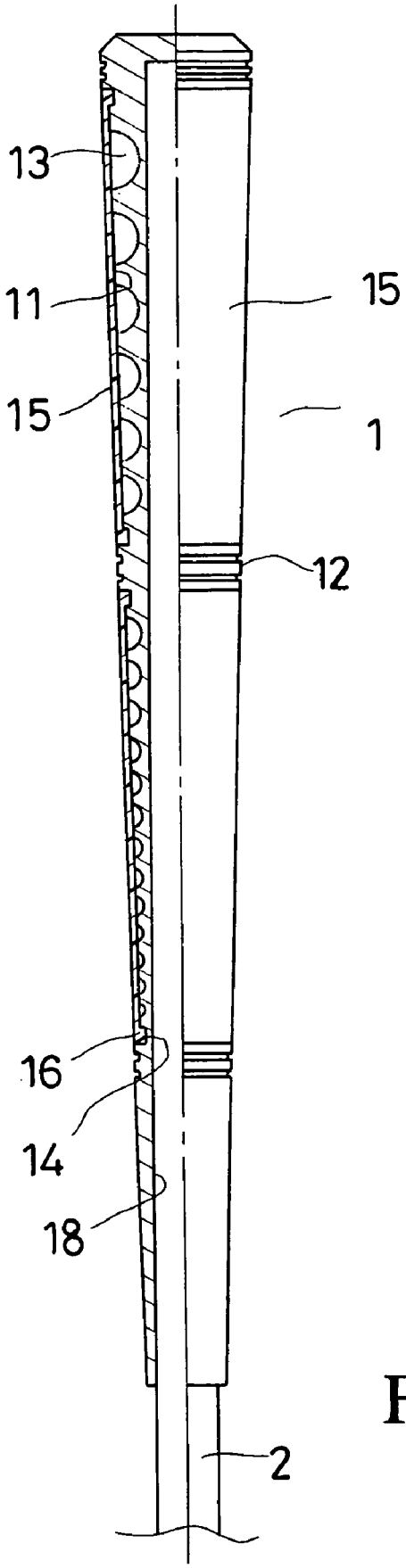
FIG. 2 is a partial vertical section of the golf club according to the present invention.
Figure 3:
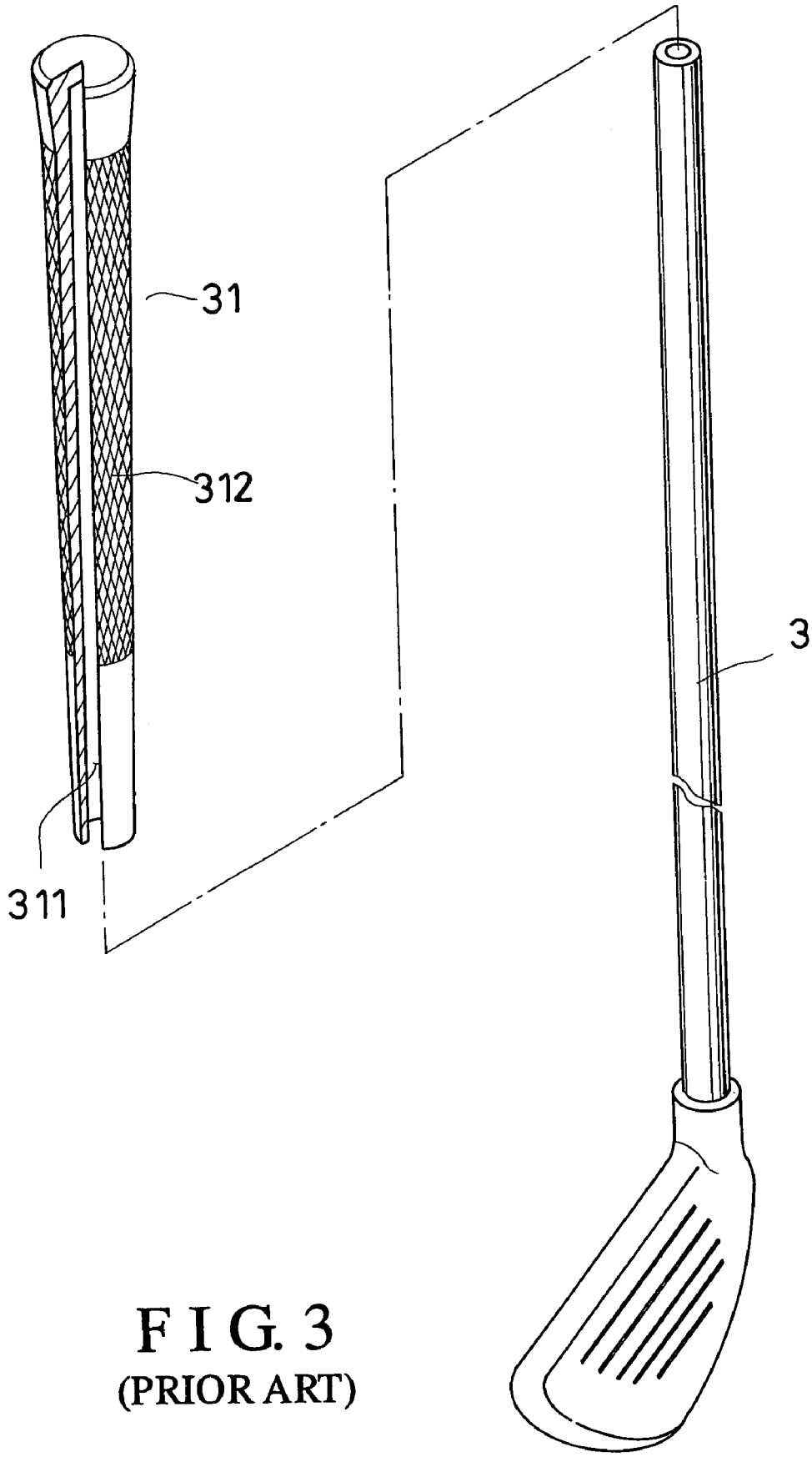
F I G. 3 (PRIOR ART)
FIG. 3 is an exploded perspective view of the conventional golf club.
Figure 4:
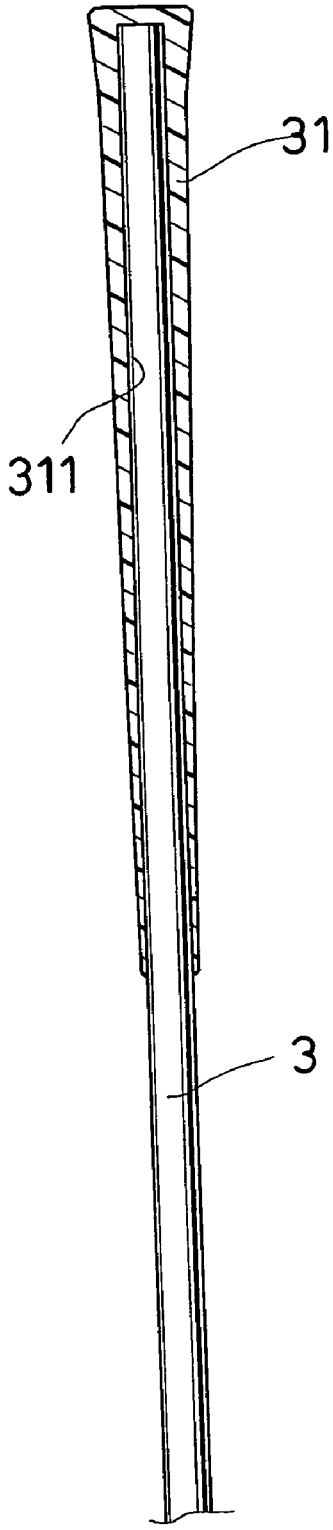
F I G. 4 (PRIOR ART)
FIG. 4 is partial vertical section of the conventional golf club.

Referring to FIGS. 1 and 2, a preferred embodiment 1 of a air cushion type sleeve of a handle of a golf club includes an inner sleeve part, and two outer sleeve parts 15.

The inner sleeve part has two annular connecting recesses 11 on an outer side, an annular protrusion 12 between the connecting recesses 11, spaced circular concavities 13 on the connecting recesses 11, annular fitting trenches 14 on two ends of each of the connecting recesses 11, and a fitting room 18. The inner sleeve part tapers towards a lower end, and the circular concavities 13 have different diameters and depths, which vary according to the diameter of the inner sleeve part. Preferably, those of the circular concavities 13 that are on a thicker portion of the inner sleeve part have a greater diameter and depth than those that are on a thinner portion of the inner sleeve part; in other words, diameters and depths of the circular concavities 13 decrease as the diameter of the inner sleeve part decreases.

Each of the outer sleeve parts 15 has annular fitting protrusions 16 on two ends of an inner side thereof, and has an outer side 17 formed in such a way as to prevent slip.

The outer sleeve part is securely fitted onto a handle end portion of a golf club from the fitting room 18. And, the outer sleeve parts 15 are positioned around respective ones of the annular connecting recesses 11 of the outer sleeve part with the annular protrusions 16 being fitted in the corresponding annular trenches 14. In addition, the annular protrusions 16 are stuck to the inner sleeve part by means of adhesive such that sealed rooms are formed between the inner sleeve part and the outer sleeve parts 15, in which rooms air is contained.

Thus, the sleeve can function like an air cushion with a soft touch, capable of making a user of the club feel comfortable and effectively absorbing the violent reaction force against the hands in hitting a golf ball. When using the golf club, one can hold the sleeve with a thumb and an index finger being pressed against the annular protrusion 12 of the inner sleeve part. And, the slip-prevention outer side of the outer sleeve parts 15 can effectively prevent slip of the golf club.

From the above description, it can be understood that with the sealed rooms between the inner sleeve part and the outer sleeve parts, the present sleeve of a golf club handle can more effectively reduce discomfort to the user's hands in fitting a ball than the conventional one described in Background.

What is claimed is:

1. An air cushion sleeve of a handle of a golf club, comprising:

an inner sleeve part securely fitted on a handle end portion of the golf club; the inner sleeve part having a plurality of spaced cavities on an outer side thereof, wherein said inner sleeve part tapers towards one end, and diameters and depths of said cavities vary according to a diameter of said inner sleeve part; and a plurality of outer sleeve parts positioned around the inner sleeve part;

each of the outer sleeve parts being connected to the inner sleeve part at two ends in a sealing manner such that an air containing sealed room is formed between it and the inner sleeve part.

2. The air cushion sleeve of a golf club handle as claimed in claim 1, wherein the cavities on the inner sleeve part are circular concavities.

3. An air cushion sleeve of a golf club handle comprising:

an inner sleeve part securely fitted on a handle end portion of the golf club; the inner sleeve part having a plurality of spaced cavities on an outer side thereof, wherein the inner sleeve part is formed with upper and lower annular recesses on an outer side thereof, on which the cavities are formed, and around which the outer sleeve parts are positioned, and the inner sleeve part has an annular protrusion between the upper and the lower annular recesses for fingers and thumbs of a user to be pressed against; and a plurality of outer sleeve parts positioned around the inner sleeve part, each of the outer sleeve parts being connected to the inner sleeve part at two ends in a sealing manner such that an air containing sealed room is formed between it and the inner sleeve part.

4. The air cushion sleeve of a golf club handle as claimed in claim 3, wherein the cavities on the inner sleeve part are circular concavities.

5. The air cushion sleeve of a golf club handle as claimed in claim 3, wherein the inner sleeve part tapers towards one end, and diameters and depths of the cavities vary according to a diameter of the inner sleeve part.

* * * * *